United States Patent [19]

Kusumoto

[11] 4,044,547

[45] Aug. 30, 1977

[54] TIME ADJUSTING SYSTEM FOR AN ELECTRONIC TIMEPIECE

[75] Inventor: Yasuo Kusumoto, Matsudo, Japan

[73] Assignee: Kabushiki Kaisha Daini Seikosha, Japan

[21] Appl. No.: 639,767

[22] Filed: Dec. 11, 1975

[30] Foreign Application Priority Data

Dec. 11, 1974 Japan ..... 49-142098

[51] Int. Cl.[2] ..... G04B 27/00

[52] U.S. Cl. ..... 58/85.5; 58/23 R

[58] Field of Search ..... 58/23 R, 50 R, 85.5

[56] References Cited

U.S. PATENT DOCUMENTS

| | | | |
|---|---|---|---|
| 3,643,418 | 2/1972 | Rolin et al. | 58/23 R |
| 3,733,803 | 5/1973 | Hiraga | 58/85.5 |
| 3,810,356 | 5/1974 | Fujita | 58/85.5 |
| 3,889,460 | 6/1975 | Yasukawa | 58/23 R |
| 3,948,035 | 4/1976 | Kusumoto | 58/85.5 |

*Primary Examiner*—Robert K. Schaefer
*Assistant Examiner*—Vit W. Miska
*Attorney, Agent, or Firm*—Robert E. Burns; Emmanuel J. Lobato; Bruce L. Adams

[57] ABSTRACT

A time adjusting system for an electronic timepiece has a discriminating circuit for discriminating between an advanced signal appearing during the first 30 seconds of a minute and a delayed signal appearing during the latter 30 seconds of the minute. In the advanced state, the supply of 1 HZ pulses to the time-measuring device is temporarily stopped for a time equivalent to the duration of the advanced time thereby delaying the time. In the delayed state, time adjusting pulses higher in frequency than the 1 HZ pulses are supplied to the time-measuring device in a number equal to the duration of the delayed time thereby advancing the time.

1 Claim, 1 Drawing Figure

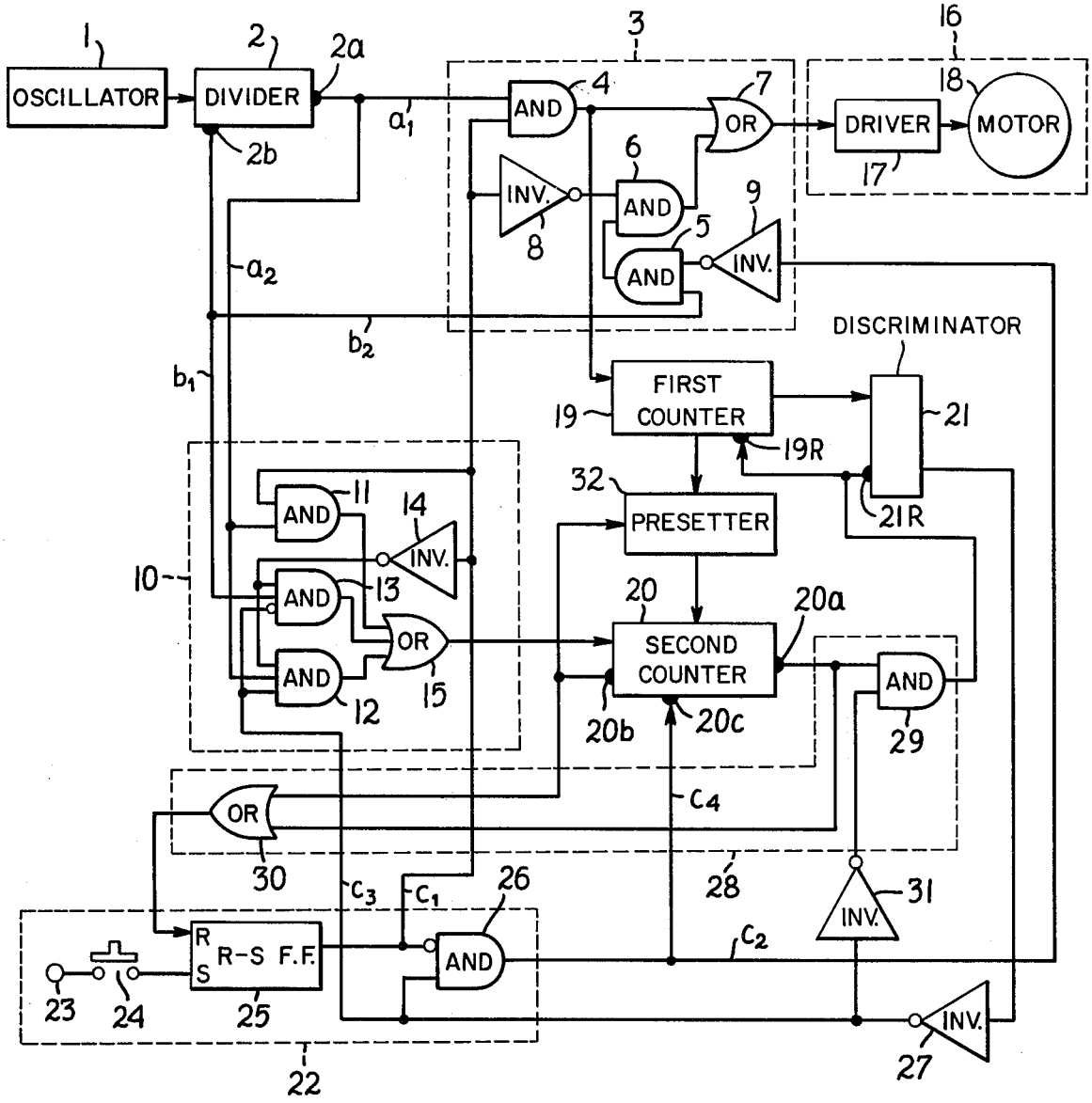
OSCILLATOR
DIVIDER
AND
OR
DRIVER
MOTOR
INV.
DISCRIMINATOR
FIRST COUNTER
PRESETTER
SECOND COUNTER
R-S F.F.
R
S

TIME ADJUSTING SYSTEM FOR AN ELECTRONIC TIMEPIECE

BACKGROUND OF THE INVENTION

This invention relates to a time adjusting system for an electronic timepiece having an updown counter for adjusting the first half 30 seconds or the latter half 30 seconds of 1 minute.

In the conventional type timepiece, the manual setting is employed, when the time is fitted to the certain time whereby the timepiece is operated. As another way, a time adjusting pulse having a higher frequency instead of than the standard 1HZ pulse is applied to the movement until the displayed time comes to the correct time. However, in said conventional ways, it is very difficult to adjust the time and the time adjusting procedure is complicated. Further it is necessary to make the adjustment many times in order to set the desired time.

OBJECT OF THE INVENTION

The present invention aims to eliminate the above noted difficulty and insufficiency, and therefore it is the primary object of the present invention to provide an accurate time adjusting system having a short operational time for the electronic timepiece.

SUMMARY OF THE INVENTION

In a time adjusting system for an electronic timepiece, a discriminating circuit discriminates the advanced signal appearing during the first half 30 seconds and the delayed signal appearing during the latter half 30 second of 1 minute. When the time is in an advanced condition, i.e. too fast, in the first half 30 seconds the supplying of the 1HZ signal is stopped, and on the contrary, when the time is in the delayed condition, i.e. too slow, in the latter half 30 seconds the 1HZ signal is additionally supplied.

BRIEF DESCRIPTION OF THE DRAWING

The above mentioned and further objects, features and advantages of the present invention will become more obvious from the following description when taken in connection with the accompanying drawing, which show one preferred embodiment and wherein:

The single FIGURE shows an embodiment in block diagram form of the time adjusting system of the present invention.

DETAILED DESCRIPTION OF THE INVENTION

This invention relates to the improvement of a time adjusting system for an electronic timepiece.

The FIGURE shows the circuit of one embodiment of the time adjusting system for the electronic timepiece and comprises an oscillating circuit 1 using a crystal vibrator, the oscillating output signal of said oscillating circuit 1 being divided to 1 HZ pulse and 32 HZ pulse for effecting the time adjustment via the dividing circuit 2. Said 1HZ pulse from the output terminal 2*a* of said dividing circuit 2 is applied to one input terminal of the both AND circuit 4 which comprising a part of the first gate circuit 3 via the line $a_1$, and is applied to one input terminal of both AND circuit 12 and AND circuit 11 which comprise a part of the second gate circuit 10 via the line $a_2$ which is divided from the line $a_1$.

The 32 HZ pulse used for effecting the time adjustment is generated from the output terminal 2*b* of said dividing circuit 2 and is applied to one input terminal of the inputs AND circuit 13 which comprises a part of said second gate circuit 10 via the line $b_1$, and is applied to one input terminal of the AND circuit 5 which forms a part of said first gate circuit 3 via the line $b_2$ which is divided from the line $b_1$.

Said first gate circuit 3 is composed of the AND gate circuits 4, 5 and 6, the OR circuit 7 and the inverters 8 and 9. The second gate circuit 10 is composed of the AND circuit 11, the AND circuit 12, the AND circuit 13 having the reversing circuit to one input side, inverter 14 and an OR circuit 15.

In normal operation, the 1HZ pulse is gated through the first gate circuit 3, and is applied to the time measuring device 16. Said time measuring device 16 is composed of the driving circuit 17 for generating the driving pulse having the positive and negative signal in response to the input pulse and applying the same to the motor 18 for rotating the hands of the timepiece. However, as an alternate time measuring device, the completed electronic timepiece having the counters of second, minute, hour and date, the decoder, the driver and the display of the liquid crystal or the light emitting diode is preferable. The 1HZ pulse which is gated through the AND circuit 4 of said first gate circuit 3 is applied to the first counter 19 as the 30-counter, and the output of the second gate circuit 10 namely the output of the OR circuit 15 is applied to the second counter 20 as the up-down counter of 30-counter.

The first counter 19 generates a carrier signal after counting 30-counts of 1HZ pulse. Said carrier signal is applied to the discriminating circuit 21 composed of a standard flip flop circuit. Said discriminating circuit 21 generates the [0] signal which is termed the advancing signal during the time the first counter 19 counts the first half 30 seconds of 1 minute, and generates the [1] signal which is termed the delaying signal during the time the first counter 19 counts the latter half 30 seconds of 1 minute. Namely said discriminating circuit 21 generates the advancing and delaying signals alternatively in response to said carrier signal which is generated whenever said first counter 19 counts 30 of the 1HZ pulses. Therefore, the advanced condition means that the second hand or display indicates the time in seconds from [0] second to [29] seconds, whereas the delayed condition means that the second hand or display indicates the time in seconds from [30] seconds to [59] seconds.

Numeral 22 is the control circuit for controlling the operations of said first and second gate circuits 3 and 10. Said control circuit 22 is composed of the manually operable switch 24 in which one contact terminal connected to the power terminal 23 having [1] signal, R-S flip-flop 25 in which the setting terminal S is connected to the other contact terminal of the switch 24, and the AND circuit 26 in which the reversing circuit is connected to the input side. The output of R-S flip-flop 25 is applied to the reversing input terminal, the output of said discriminating circuit 21 is applied to the other input terminal via the inverter 27. The control signal as the output of the control circuit 22 is generated from the R-S flip-flop circuit 25 and the AND circuit 26, the output of the R-S flip-flop circuit 25 is applied to the inverter 8 and the circuit 4 of the first gate circuit 3 via the line $C_1$, and is further applied to the circuit 11 of the second gate circuit 10 and the inverter 14. The output of said inverter 8 is applied to the circuit 6, the output of the inverter 14 is applied to the AND circuits 12 and 14.

The control signal is applied to the inverter 9 of the first gate circuit 3 via the line $C_2$, further the output of the inverter 9 is applied to the gate 5.

The output signal of the discriminating circuit 21 which is applied to one input terminal of the AND circuit 26 of the control circuit 22 via the inverter 27 is applied to one input terminal of the AND circuit 12 of the second gate circuit 10 via the line $C_3$ and further is applied to the reversing input terminal of the AND circuit 13.

Said second counter 20 generates [1] signal from the output terminal 20*a* when said second counter 20 is operated in its up counting mode whereby the counting contents become [30] counts, further said second counter 20 generates [1] signal when said second counter 20 is operated in its down counting mode whereby the counting contents becomes [0]. The output signal of the output terminal 20*a* is applied to the circuit 29 consisting of the resetting circuit 28 and the input terminal of the circuit 30, the output signal of the output terminal 20*b* is applied to the other input terminal of the OR circuit 30. The resetting signal which is generated from the circuit 29 is applied to the resetting terminal 19R of the first counter 19 and the resetting terminal 21R of the discriminating circuit 21. Further the resetting signal which is generated from the circuit 30 is applied to the resetting terminal R of the R-S flip-flop 25. The output signal of the discriminating circuit 21 is applied to the other input terminal of the AND circuit 29 of said resetting circuit 28 via the inverters 27 and 31.

The counting contents of said first counter 19 is applied to the presetting circuit 32, the counting contents of said first counter 19 is preset to the second counter 20 via said presetting circuit 32 in synchronization to the output signal from the output terminal 20*b* of said second counter 20. The control signal from the control circuit 22 is applied to the mode switching terminal 20*c* of said second counter 20 via the line $C_4$ being separated from the line $C_2$, the operational mode of said second counter 20 is changed to the up-counting mode or the down-counting mode.

Referring now to the operation of the embodiment of the present invention:

In the normal operation of the electronic timepiece, the output of the R-S flip-flop 25 of the control circuit 22 is [1] signal and the line $C_1$ is kept to [1] signal whereby 1HZ pulse from said dividing circuit 2 is applied to the time measuring device 16 via the circuit 4 and the circuit 7 of said first gate circuit 3, and is applied to said first counter 19 via the circuit 4, and further is applied to said second counter 20 via the AND circuit 11 of said second gate circuit 10 and the circuit 15. At this time, said second counter 20 is operated in the up-counting mode because the lines $C_2$ and $C_4$ are kept to [0] signal is applied to the mode switching terminal 20*c*. Therefore, said first and second counters 19 and 20 are synchronously operated, the counting contents are substantially equal, and further said time measuring device 16 is normally operated by receiving the 1HZ pulse as the time standard.

Referring now to the operational condition for effecting the time adjustment and assuming that the switch 24 is actuated when the time is just 0-second. During this operation, for example, if the second display indicates the time from 30 to 59 seconds, this time of seconds is discriminated as the delayed time. On the contrary, if the second display indicates the time from 0 to 29 seconds, this time of seconds is discriminated as the advanced time.

If the time is discriminated as the delayed time at the time of operation of the switch 24, the first counter 19 and the second counter 20 as the 30-counter have the counting contents of the latter half 30-seconds of 1 minute, and the [1] signal as the delayed signal is generated from said discriminating circuit 21. For example, in 5 seconds later, the counting contents of said first counter 19 and second counter 20 have counting contents of 25-seconds. In response to the operation of the switch 24, the output of the R-S flip-flop 25 is changed to [0] signal whereby the 1HZ pulse is not generated from the circuit 4 of said first gate circuit 3 wherein the input pulse to said first counter 19 ceases. Further, 1HZ pulse output from the circuit 11 of said second gate circuit 10 ceases whereby 1HZ pulse is not applied to said second counter 20, on the contrary, the time adjusting pulse of 32 HZ from said dividing circuit 2 is applied to the second counter 20 via the circuit 13 and the circuit 15. Further, said time adjusting pulse is applied to the time measuring device 16 via the AND circuit 5 of said first gate circuit 3, the circuit 6 and the circuit 7. As the above noted description, the output of said discriminating circuit is the [1] signal in the delayed condition, the output of said circuit 26 of said control circuit 22 in which the reversed signal of said [1] signal is applied to, whereby said secound counter 20 is operated in the up-counting mode. During the time adjusting the pulse is 5/32 second, namely the signal of five is applied to said counter 20 in the fast speed when the counting contents became 30 whereby [1] signal is generated from the output terminal 20*a*. Further the resetting signal is generated from the circuit 29 and the two inputs-OR-circuit 30 of said resetting circuit 28 by said [1] signal, whereby said first counting circuit 19, said discriminating circuit 21 and said R-S flip-flop circuit 25 are all reset. Namely, the counting contents of said first counter 19 is reset to the time from 25 seconds to 0 second as substantially the same as the counting contents of said second counter 20, the output of said discriminating circuit 21 is reset to [0], and the output of said R-S flip-flop circuit 25 is reset to [1] signal. Therefore, during the above noted operation, the second display of the time measuring device is adjusted from 55-seconds to 0-second by five pulses which is applied to said time measuring device 16 in the fast speed. 5/32 second is necessary for adjusting the time of 5 seconds later. The time adjusting operation of said time measuring device is ended by the resetting of said R-S flip flop circuit 25 thereby returning the timepiece to the normally operated condition.

Further, when said switch 24 is operated and the advanced time is discriminated, said first counter 19 and said second counter 20 as said 30-counter have the counting contents of the first half 30 seconds per 1 minute the [0] signal as the advancing signal is generated from said discriminating circuit 21. For example, if the time advanced five seconds, the counting contents of said first counter 19 and second counter 20 correspond to 5 seconds.

The supply of 1HZ pulse to said time measuring device 16 and first counter 19 is ceased in response to the output of said R-S flip flop circuit 25 which is changed to ]0] by the operation of said switch 24, whereby 1HZ pulse from said dividing circuit 2 is supplied to said second counter 20 via the circuit 12 and circuit 15 of said second gate circuit 10 by the output of said discriminating circuit 21 being [0] and the line $C_1$ being [0]. At this time, the output of said discriminating circuit 21 is [0] and the output of said R-S flip-flop circuit 25 is [0] whereby the output of said gate 26 of said control circuit 22 is [1], then the operation of said second counter 20 is changed to the down-counting mode by said [1] signal which is applied to the mode switching terminal 20C.

Five 1HZ pulses are applied to said second counter 20 whereby the counting contents of said second counter 20 is changed from 5 seconds to 0-second and [1] signal is generated from the output terminal **20*b*. The resetting signal is applied from the resetting circuit 28 to the R-S flip flop circuit 25 by said [1] signal whereby the output of said R-S flip flop circuit 25 is changed to the [1] signal of the normal condition, and the stopped counting contents of said first counter 19 is preset to the second counter 20, then the counting contents of said first and second counters coincide with each other. Namely the counting contents of both become 5 seconds. No pulse is applied to said time measuring device 16 for the time of 5 seconds until said R-S flip flop circuit 25 is reset whereby the second display keeps displaying said 5 seconds. As soon as said R-S flip flop circuit 2 is reset, the operation of said second counter 20** is changed to the up-counting mode and the operation of the timepiece is returned to the normal condition.

In the above noted discussion of the delayed condition, the time adjusting pulses only corresponding to the delaying is automatically applied to the time measuring device 16 whereby the time adjusting is operated. On the contrary, in the advanced condition, the pulse supply to the time measuring device 16 is stopped for a period of time only corresponding to said advancing whereby the time adjusting is automatically attained.

We have explained the detailed embodiment of the time adjusting system for the electronic timepiece of the present invention based on the preferred drawing, however, the present invention is not restricted to the described embodiment, it is able to change and modify the noted embodiment without restriction about this embodiment.

According to the present invention, the advanced condition and delayed condition of the time measuring device are automatically discriminated by the output of said discriminating circuit, further the operating mode of said second counter which is the up-down counter is switched by the signal in response to the discriminated contents. In the delayed condition, the time adjusting pulses having a number of pulses of corresponding to the delayed amount are applied to the time measuring device, in the advanced condition, the supply of the pulses to the time measuring device is stopped only for the time of corresponding to the advanced amount whereby the time adjusting is automatically operated.

It is able to simply operate the time adjusting and further to operate accurately and shortly the above noted operation.

What we claim is:

1. A time adjusting system for an electronic timepiece comprising: an oscillator circuit for generating high frequency pulses; a dividing circuit connected to said oscillator circuit for dividing the high frequency pulses therefrom into 1 HZ pulses for use as time standard pulses and higher frequency pulses higher in frequency than 1 HZ for use as time adjusting pulses; a time-measuring device for measuring time in response to the 1 HZ pulses; a first counter for selectively counting 30 1 HZ pulses from said dividing circuit and providing a corresponding count signal; a discriminating circuit for discriminating between an advanced signal appearing during the first 30 seconds of 1 minute and a delayed signal appearing during the latter 30 seconds of the 1 minute in response to the count signal provided by said first counter; a second counter comprising an up-down 30-counter for counting 1 HZ pulses when counting in an up-counting mode; a first gate circuit connected to said dividing circuit to receive therefrom the 1 HZ pulses and the higher frequency pulses operative to selectively apply them to said time-measuring device and operative to selectively apply the 1 HZ pulses to said first counter; a second gate circuit connected to said dividing circuit to receive therefrom the 1 HZ pulses and the higher frequency pulse and operative to selectively apply them to said second counter; a manually operable switch operable to initiate the time adjustment; control circuit means responsive to operation of said switch for generating a control signal and applying it to said first gate circuit which responds thereto to stop the supply of 1 HZ pulses and higher frequency pulses to said time-measuring device and to stop the supply of the 1 HZ pulses to said first counter, and applying the control signal to said second gate circuit which responds thereto to supply 1 HZ pulses to said second counter and for changing the operation of said second counter to the down-counting mode when said advanced signal is generated from said discriminating circuit, and applying the control signal to said first gate circuit and second gate circuit which respond thereto to supply the higher frequency pulses to said time-measuring device and second counter when said delayed signal is generated from said discriminating circuit; a pre-setting circuit for presetting the counting content of said first counter in said second counter when operating in the down-counting mode when the counting content reaches 0-second in response to the control signal; and a resetting circuit for resetting said control circuit when the counting content of said second counter reaches 0-second when operating in the down-counting mode in response to the control signal, and for resetting said control circuit, first counter and discriminating circuit when the counting content of said second counter reaches 30-seconds when operating in the up-counting mode.

* * * * *